US010714239B2

(12) United States Patent
Sundelin

(10) Patent No.: US 10,714,239 B2
(45) Date of Patent: Jul. 14, 2020

(54) CORROSION RESISTANT FASTENER

(71) Applicant: Ronald Murl Sundelin, Yorktown, VA (US)

(72) Inventor: Ronald Murl Sundelin, Yorktown, VA (US)

( * ) Notice: Subject to any disclaimer, the term of this patent is extended or adjusted under 35 U.S.C. 154(b) by 109 days.

(21) Appl. No.: 16/350,091

(22) Filed: Sep. 24, 2018

(65) Prior Publication Data

US 2020/0098494 A1 Mar. 26, 2020

(51) Int. Cl.

| | |
|---|---|
| ***H01B 17/56*** | (2006.01) |
| ***B63C 5/02*** | (2006.01) |
| ***B63C 3/06*** | (2006.01) |

(52) U.S. Cl.

CPC ..... *H01B 17/56* (2013.01); *B63C 5/02* (2013.01); *B63C 3/06* (2013.01)

(58) Field of Classification Search

CPC .. H01B 17/56; B63C 5/02; B63C 3/06; C23F 2213/31; C23F 13/06

See application file for complete search history.

(56) References Cited

U.S. PATENT DOCUMENTS

| | | | | |
|---|---|---|---|---|
| 5,714,805 | A * | 2/1998 | Lobaugh | H01R 24/58 307/10.1 |
| 5,833,417 | A * | 11/1998 | Sargent | F16B 37/046 411/85 |
| 7,038,339 | B2 * | 5/2006 | Gandrud | H02K 5/225 310/71 |
| 7,226,041 | B2 * | 6/2007 | Ledford | B66D 1/14 114/44 |
| 7,688,595 | B2 * | 3/2010 | Garmong | H05K 9/0001 361/752 |
| 7,795,541 | B2 * | 9/2010 | Hiltbrunner | H02G 5/066 16/2.1 |
| 9,140,764 | B2 * | 9/2015 | Davis | G01N 27/223 |
| 9,490,555 | B1 * | 11/2016 | Schmit | B60L 50/00 |

* cited by examiner

*Primary Examiner* — Michael C Zarroli

(57) ABSTRACT

An object of this invention is to prevent the collapse of structures such as boat lifts, where the collapse is caused by corrosion of metal fasteners inside conductive material such as moist wood in the presence of ground voltage differences, and where the corrosion is prevented by blocking current from flowing through the fasteners.

6 Claims, 1 Drawing Sheet

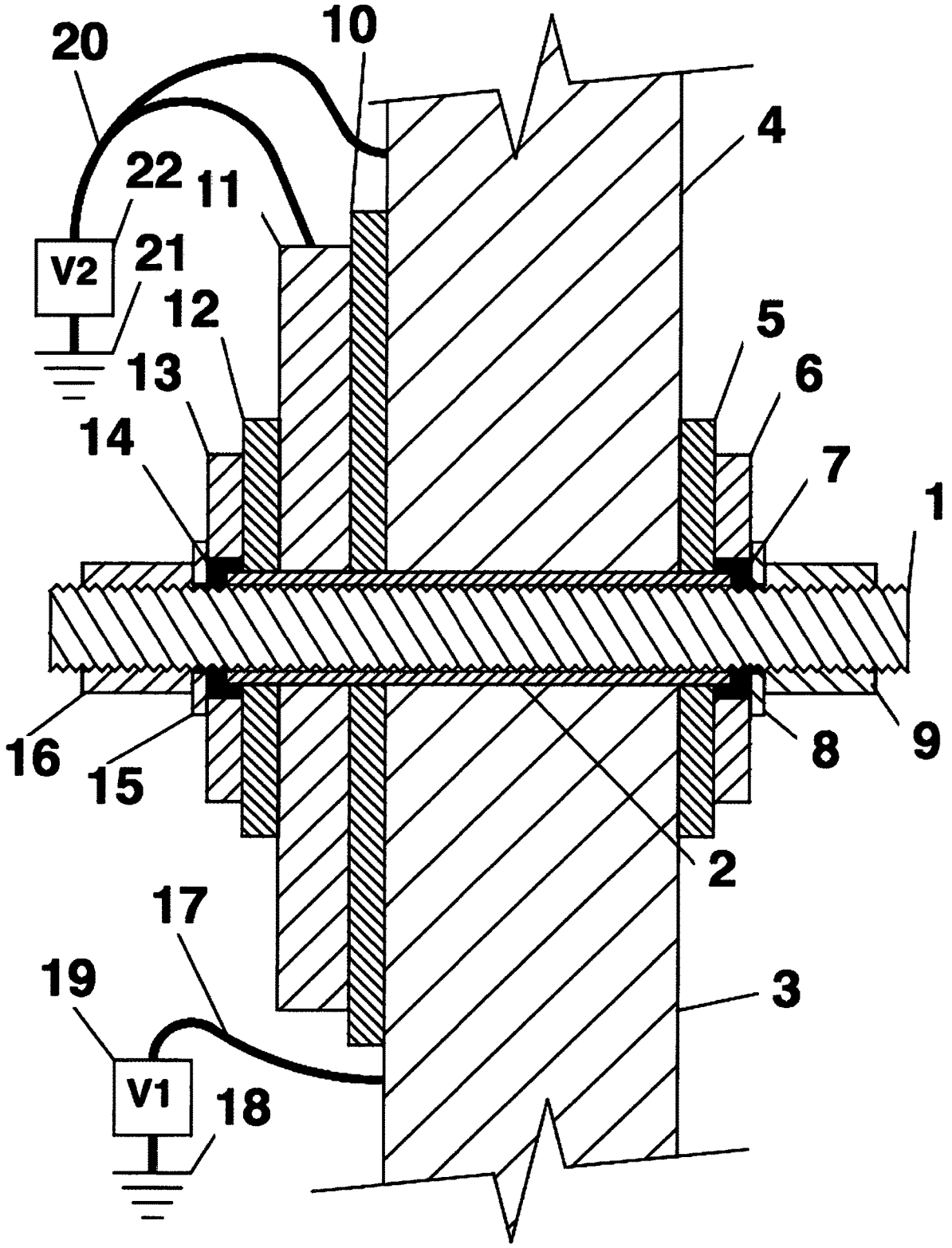
20
10
4
22
11
V2
21
12
5
13
6
14
7
1
16
15
8
9
2
17
19
3
V1
18

CORROSION RESISTANT FASTENER

CROSS-REFERENCE TO RELATED APPLICATIONS

Not applicable.

FEDERALLY SPONSORED RESEARCH OR DEVELOPMENT

Not applicable.

PARTIES TO A JOINT RESEARCH AGREEMENT

Not applicable.

PRIOR DISCLOSURES BY INVENTOR

In or about 2011, as a public service the inventor disclosed information related to, but of a lesser scope than, this invention. Details are in the next section.

BACKGROUND OF THE INVENTION

This invention addresses corrosion of fasteners connecting equipment such as boat lifts to wooden supports such as pilings. A number of approaches have been used to mitigate this problem, but each has certain disadvantages. This corrosion is not readily observed because it takes place inside an opaque piling, and the visible portions exhibit little or no corrosion. The rate at which the corrosion takes place is generally not appreciated because two different ground voltages are normally involved, and the voltage difference can greatly accelerate the corrosion rate.

For side-mounted boat lift brackets, there are typically two bolts holding each bracket to a piling. The piling, typically pressure treated wood, tends to wick water and exhibit moderate electrical conductivity (hereinafter referred to as quasi-conductivity, as defined in [0021]), and typically is in contact with earth ground potential. A boat lift is normally made of metal, is operated using 120 or 240 volts, and is connected to a personnel safety ground.

Depending on the relative polarity of the grounds, a non-negligible current can flow from the earth ground, preferentially through the lower bolt, through the support bracket, through the boat lift, and to the safety ground. Given sufficient time, this current has been observed to remove the central 85% of the lower bolt, and up to 80% of the cross section of the upper bolt at some locations. The associated voltage was 1 volt, and the current 0.003 amperes. The time to cause the described damage was 0.02 ampere-years.

A partial solution to this problem is to install electrical insulation between the boat lift longitudinal beams and their support brackets. While this is a desirable thing to do, it is inadequate because various other items connected to the personnel safety ground are also connected to various parts of the wooden structure. Such items include flexible metal conduit with an easily penetrated insulating coating, the boat lift control box, and the electrical breaker panel. The result of this was that current from the ocean ground traveled up a piling, transferred to a lower bolt holding a boat lift support bracket, travelled through the bracket, transferred through the upper bolt back into the piling, and continued up the piling to a place that the safety-grounded conduit was in contact with the piling. This caused both bolts to corrode through and for the boat lift to collapse seven years after installation. This collapse caused major property damage and caused a risk of personnel injury or death. The present invention is intended to prevent such an event from occurring.

Other approaches that have been taken to mitigate corrosion in marine environments include use of sacrificial anode material (U.S. Pat. No. 3,887,449-A, Robert B Baer, Jun. 3, 1975; JP-4146994, Untranslated, Sep. 10, 2008), modulated current between anode and cathode (U.S. Pat. No. 5,627,414-A, Fordyce M. Brown et al., May 6, 1997; US-2009138148-A1, Sridhar Deivasigamani, abandoned), and triggerable solid state devices to bring the two ground voltages closer to each other (U.S. Pat. No. 5,840,164-A, Richard E. Staerzl, Nov. 24, 1998). The first of these approaches has the disadvantage that the sacrificial material needs to be monitored and periodically replaced; the second and third have the disadvantage of requiring a power source, special controls, and the disadvantage that the personnel safety ground could be rendered ineffective. Another approach is to use two bolts, one of which is designed to fail long before the second one fails (U.S. Pat. No. 9,823,690, Bowers , et al., Nov. 21, 2017). This approach has the disadvantage that the bolts must be monitored and periodically replaced. In addition to the patent search indicated above, discussions with boat lift manufacturers and an experienced boat lift installer indicate that the prior art provides no satisfactory solution to the problem addressed by this invention.

The inventor believes the present invention has the most overlap with USPC groups 52.515, 52.517, 174.23R, 204.96.16, and 204.196.37, and with CPC groups A47L, B23F, B27K, B41N, C04B, C09D, C09J, C23C, C23F, F16L, G01N, H01B, H01Q, H01R, and H02G.

BRIEF SUMMARY OF THE INVENTION

This invention avoids corrosion and breakage of fasteners used to fasten apparatus to quasi-conductive material such as pressure treated wood by electrically and chemically isolating the fastener from the material in which it is embedded. The isolating material is selected to have the properties of being a good electrical insulator, resistant to the chemicals present, not subject to fracture from mechanical shock, and not subject to excessive cold flow under moderately high pressures. The invention is for use in locations where two different ground voltages are present. One is typically an earth ground and the other a personnel safety ground. The load being supported is preferably isolated from the fastener to simplify verification that the fastener is isolated.

BRIEF DESCRIPTION OF THE DRAWING

The invention is most easily understood with a sectional view, looking horizontally, in which the axis of a metallic fastener lies in the plane of the section, as illustrated in the drawing. The drawing shows a fastener embedded in an electrically quasi-conductive material such as a moist pressure treated wooden piling, material which isolates the fastener from the quasi-conductive material, a supported load, and auxiliary components which operate cooperatively to accomplish the objectives of the invention. Connections to the grounds are shown schematically.

DETAILED DESCRIPTION OF THE INVENTION

A common problem, especially in marine structures, is the corrosion and subsequent breakage of metallic fasteners inside electrically quasi-conductive material such as pressure treated wood in which moisture is present. This problem is made much worse if the quasi-conductive material has an electrical connection to two different grounds at potentially different voltages. One ground commonly encountered is the earth ground contacted by a piling. A second ground commonly encountered is a personnel safety ground which is connected to electric-motor-driven or other equipment which is in contact with the same electrically quasi-conductive material. In such a configuration, a ground voltage difference of 1 volt has been encountered, and a current of 3 milliamperes has been measured. The current and time required to cause fastener failure is approximately 20 milliampere-years. Corrosion of the fasteners is not visible because it occurs inside the pilings. The rate of corrosion is increased at the location of stresses in the fastener. This information was made public several years ago by the present inventor. This information specified that longitudinal beams in a boat lift, with attached motors connected to power line ground, be electrically insulated from the support brackets connected to pilings. In a subsequent case, other ground sources farther from the brackets, such as control boxes, plastic-covered flexible metallic conduit, and breaker panels were not taken into account. These additional grounds have led to a boat lift collapse seven years after the bolts were installed. A completed 2 month test on the present invention, with a 5,000 pound shear load applied to the supported bracket, extrapolates to a corrosion lifetime inside the piling in excess of 30,000 years. Exposure to weather outside the piling would be expected to yield a shorter lifetime, but one well in excess of the lifetime of the wood.

Other reasons a second ground may be in contact with earth-grounded quasi-conductive material include illumination, availability of general purpose electrical power, and provision of electrical power to a boat. One way the galvanic corrosion can be accelerated is the connection of a safety ground to a structure which is electrically connected to a fastener embedded in the earth-grounded quasi-conductive material. A second way the corrosion can be accelerated is the connection of a second ground to the quasi-conductive material at a point, on the opposite side from earth ground, from two metallic fasteners embedded in the material if the fasteners are electrically connected to each other by a metallic path; in this case, current flowing through the quasi-conductive material will exit through one fastener, travel through the metallic path, and reenter through the second fastener, thereby corroding both fasteners.

This invention avoids problems with multiple grounds by electrically insulating the fasteners inside the quasi-conductive medium. The components attached to the ends of the fasteners are also electrically insulated from the pilings. It is also desirable, but not essential, to electrically isolate the components supported by the fasteners. The advantage of this approach is that the proper functioning of the insulation on a fastener can be verified by measuring its resistance to other objects.

The invention can be most easily understood by looking at the drawing, which shows a horizontally viewed section in which the axis of the fastener lies in the plane of the section. The drawing shows a section through a metallic fastener, a piece of lumber in which it is embedded, and a structural member which it is supporting. A metallic fastener (1) is insulated by an electrically insulating tube (2), which passes through a hole in the quasi-conductive wooden support which contains appreciable absorbed water (3) and (4). A first end of the insulating tube (2) passes through an insulator (5) and into a metal spacer (6). A sealant (7) is placed between the tube (2) and spacer (6), which spacer extends past the end of the tube (2). A metal washer (8) of the correct size for the fastener (1) and a nut (9) prevent the fastener (1) from being pulled out of the other side of the hole. On the opposite side of the quasi-conductive wooden support, an insulator (10) is placed over the insulating tube (2) and sealed to it. This insulator (10) prevents a metallic member (11) from contacting the quasi-conductive wooden support (3) and (4). Insulators (2) and (12) prevent the metallic member (11) from making electrical contact with the fastener (1). A second end of the insulating tube (2) passes throught the insulator (12) and into a metal spacer (13). A sealant (14) is placed between the tube (2) and spacer (13), which spacer extends past the end of the tube (2). A metal washer (15) of the correct size for the fastener (1) and a nut (16) prevent the fastener (1) from being pulled out of the other side of the hold. An electrical connection of the lower portion (3) of the quasi-conductive wooden support is schematically shown as the lead (17) making a connection to the ground (18) with a smaller than five volt offset (19). This offset (19) includes any portion of the voltage difference that may occur between the ground (18) and the fastener (1). The ground (18) is typically an earth ground, The ground (21), with a smaller than five volt offset represented by (22), is shown schematically as being connected by the lead (20) to either or both the metallic member (11) and the upper portion of the quasi-conductive wooden support (4). Ground (21) is typically a personnel safety ground.

The quasi-conductive material, such as pressure treated wood, is made more conductive by moisture. The moisture level and conductivity are increased if the wood is embedded in moist earth or is in contact with water, especially salt water. The materials in the wood, such as preservatives, contribute to the conductivity to the extent to which they are ionized. Quasi-conductive materials, as described herein, have lower resistivity than electrically insulating materials and higher resistivity than metals such as copper.

The insulating material should not be brittle, should be resistant to the chemicals to which it is exposed, and should be resistant to cold flow under heavy load. Polyurethane with hardness around 80 A is preferred for this purpose.

Whereas galvanic corrosion can be inhibited if the metallic object is held at a voltage of appropriate polarity, it is not practical to shift the voltage associated with earth ground, and modifying the personnel safety ground voltage would have the risk of interfering with the personnel safety and overcurrent grounding function.

As used herein, "metal" and "metallic" refer to materials with resistivity of 2 microohm-meters or less, "insulated" refers to materials with 10 megohm-meters or greater, and "quasi-conductive material" generally refers to material with resistivity between 0.002 ohm-meters and 200 ohm-meters, but may apply to a broader range in the presence of different geometries.

Quasi-conductive material useful for structural purposes includes wood, pressure treated wood, lumber, pilings, and any other material having appropriate strength, rigidity, durability, and resistivity. "Inside the conductive medium" also includes the case of corrosion taking place, in a place where it cannot be visually observed, and in which corrosion can lead to unacceptable weakening of the structure.

"Fastener" refers to any device used to control the relative motion of any number of objects which would not maintain desired positions in the absence of the fastener. The term includes, but is not limited to, bolts, screws, threaded rods, lag bolts, and lag screws, plus auxiliary components such as nuts, flat washers, and lock washers. Appropriate fastener materials include galvanized steel and stainless steel. If the latter is used, an antiseize compound may be required to prevent galling.

The spacers shown in the drawing serve the purposes of transmitting axial forces, distributing forces over a relatively large area, accommodating variations in the length of the insulating tube, and providing space for a sealant which prevents the entry of liquids into the space between the fastener and insulating tube.

The insulating materials which are installed perpendicular to the insulating tube axis should have their holes formed in such a way that the joints between the two insulators are liquid tight. Alternatively, sealant can be applied to the joint.

What is claimed is:

1. A structure comprising, in combination:

A. A wooden support;

B. Water absorbed by the wooden support which renders it electrically quasi-conductive;

C. A metallic member attached to the wooden support;

D. A metallic fastener which attaches the metallic member to the wooden support;

E. An electrical insulator surrounding the fastener where it would otherwise contact the wooden support:

F, A first ground voltage connected to the wooden support;

G. A second ground voltage, with voltage unequal to the first ground voltage, having an electrical connection to the structure; and H. Current which attempts to flow between the quasi-conductive wood and the fastener because of the voltage difference between the wooden support and the structure is blocked due to the insulator.

2. A structure according to claim 1 in which the wooden support is pressure treated wood.

3. A structure according to claim 1 in which the first ground voltage is earth ground.

4. Astructure according to claim 1 in which the second ground voltage is a personnel safety ground and is electrically connected to the metallic member attached to the wooden support.

5. A structure according to claim 1 in which the second ground voltage is a personnel safety ground and is connected to the wooden supportat a location above the fastener.

6. A structure according to claim 1 in which the attached metallic member is electrically insulated from the fastener.

* * * * *